US007360255B2

(12) United States Patent
Whitmire

(10) Patent No.: US 7,360,255 B2
(45) Date of Patent: Apr. 22, 2008

(54) MASONRY LEG GUARD

(76) Inventor: Fred M. Whitmire, P.O. Box 407, Penrose, NC (US) 28766

( * ) Notice: Subject to any disclaimer, the term of this patent is extended or adjusted under 35 U.S.C. 154(b) by 0 days.

(21) Appl. No.: 11/455,554

(22) Filed: Jun. 19, 2006

(65) Prior Publication Data

US 2007/0050876 A1 Mar. 8, 2007

Related U.S. Application Data

(60) Provisional application No. 60/714,776, filed on Sep. 7, 2005.

(51) Int. Cl.
*A41D 13/05* (2006.01)

(52) U.S. Cl. ..... 2/22

(58) Field of Classification Search ..... 2/22, 2/51, 23, 24, 466, 2.5, 61, 62, 455, 16, 20; 224/907, 661–666
See application file for complete search history.

(56) References Cited

U.S. PATENT DOCUMENTS 562,607 A * 6/1896 Herbelin ..... 2/24
589,562 A * 9/1897 Gray ..... 2/51
1,128,122 A * 2/1915 Fox ..... 2/22
1,254,808 A * 1/1918 Jones ..... 2/51
1,772,922 A * 8/1930 Volz ..... 2/22
D201,861 S * 8/1965 Cummins ..... D29/120.1
4,382,301 A * 5/1983 Hightower, Jr. ..... 2/22
4,697,286 A * 10/1987 Cho ..... 2/22
5,375,262 A 12/1994 Carter
5,415,007 A 5/1995 Eng
5,497,511 A 3/1996 Zade
5,584,072 A * 12/1996 Kim et al. ..... 2/465
5,611,079 A * 3/1997 Bain, III ..... 2/455
6,202,215 B1 * 3/2001 Sauter ..... 2/51
6,336,220 B1 1/2002 Sacks et al.
6,519,775 B1 * 2/2003 Garcia ..... 2/22
6,654,962 B2 * 12/2003 DeMott ..... 2/22
2006/0191051 A1 * 8/2006 Garcia ..... 2/22

* cited by examiner

*Primary Examiner*—Amy B. Vanatta
(74) *Attorney, Agent, or Firm*—James Ray & Assoc.

(57) ABSTRACT

An apparatus for protecting a mason or a stone worker's leg and clothing while working. The apparatus comprises a leg guard having a predetermined configuration. Such leg guard includes at least one layer having a predetermined shape and being formed from a first predetermined material, a first side of the first layer for contacting a user's leg. There is at least one strap disposed on and engageable with a top end of such leg guard for securing the leg guard to such user's belt and at least one leg strap disposed on and connected to each side of the leg guard for securing the leg guard to such user's leg.

17 Claims, 4 Drawing Sheets

MASONRY LEG GUARD

CROSS REFERENCE TO RELATED APPLICATIONS

This application is closely related to and claims benefit from U.S. Provisional Application Ser. No. 60/714,776 filed Sep. 7, 2005.

FIELD OF THE INVENTION

The present invention relates, in general, to a masonry aid, and more particularly, to an aid for protecting not only a workers clothing but also for providing protection against bruising and scraping of the thigh and leg of the worker.

BACKGROUND OF THE INVENTION

Many masons, rock cutters and others working with stones, bricks and rocks often experience bruising and scraping when working, as well as having extreme wear to clothing. Individuals often place the rock or stone with which they are working on the upper thigh portion of the leg to break or cut such rock or stone with a rock hammer. As this process is most effective for cutting or breaking rocks, the leg of the worker needs protection since the very action of cutting the stone can very easily bruise the thigh or scrape it. Further, the clothing of the worker must bear considerable strain as the stone abrades the clothing as it is being hit with the hammer.

Thus, it would be advantageous if there were a product that could protect both the worker's leg and clothing when doing masonry work with stone or rock so as to reduce the wear and tear to both the clothing and the worker's leg.

SUMMARY OF THE INVENTION

In a first aspect the present invention provides an apparatus for protecting a mason or a stone worker's leg and clothing while working. The apparatus comprises a leg guard having a predetermined configuration. Such leg guard includes at least one layer having a predetermined shape and being formed from a first predetermined material, a first side of the first layer for contacting a user's leg. There is at least one strap disposed on and engageable with a top end of such leg guard for securing the leg guard to such user's belt and at least one leg strap disposed on and connected to each side of the leg guard for securing the leg guard to such user's leg.

OBJECTS OF THE INVENTION

It is, therefore, one of the primary objects of the present invention to provide an apparatus for protecting a mason or stone worker's leg while working.

Another object of the present invention is to provide an apparatus for protecting the clothing of a mason or stone worker while working.

Still another object of the present invention is to provide an apparatus for protecting a mason or stone worker's leg and clothing while working that is easy to use.

Yet another object of the present invention is to provide an apparatus for protecting a mason or stone worker's leg and clothing while working that is relatively inexpensive.

These and various other objects and advantages of this invention will become apparent after a full reading of the following detailed description, particularly, when read in conjunction with the attached drawings as described below and the appended claims.

Figure 1:
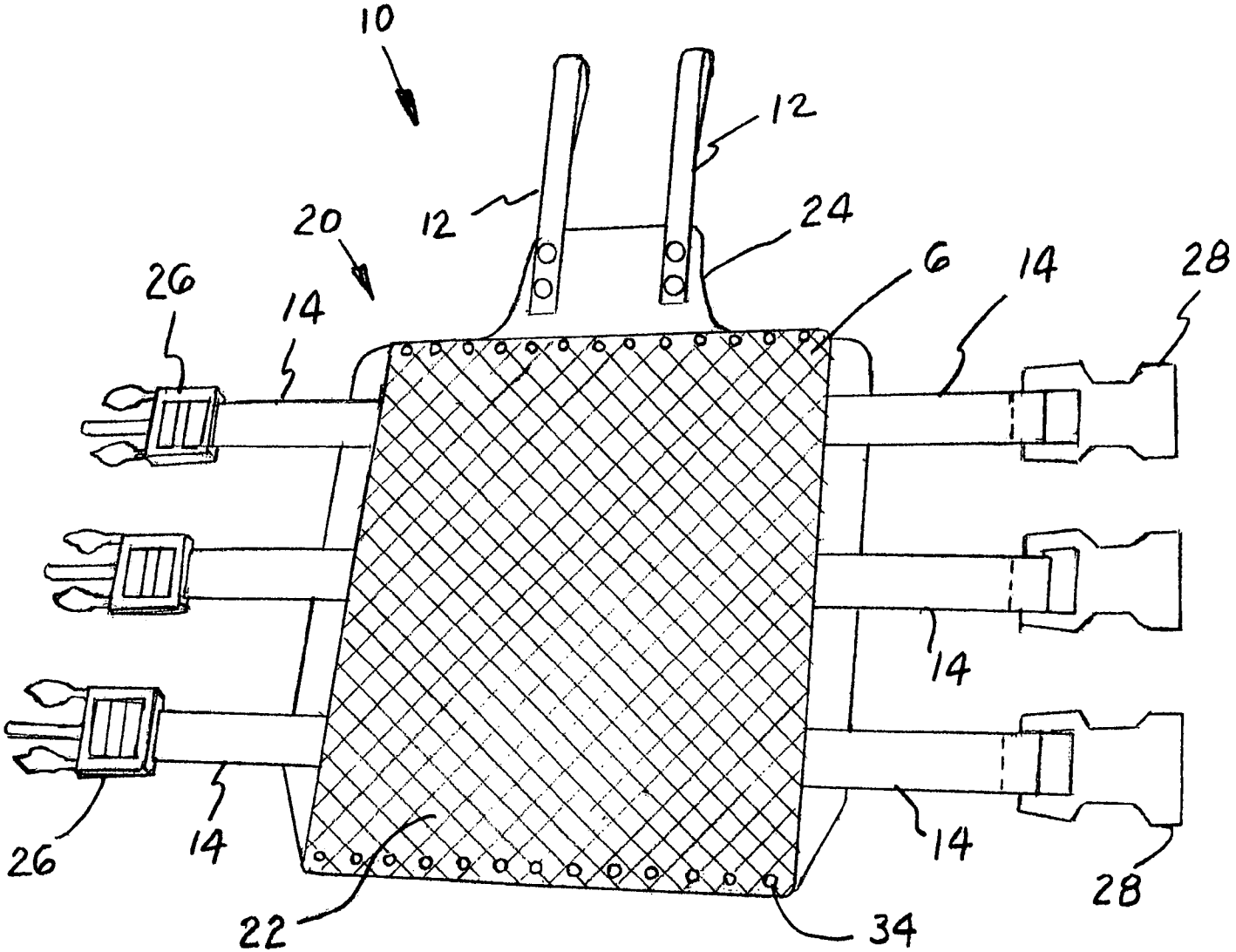
FIG. 1 is a perspective view of the apparatus showing the side of the apparatus that contacts the items being hit with a hammer.
Figure 2:
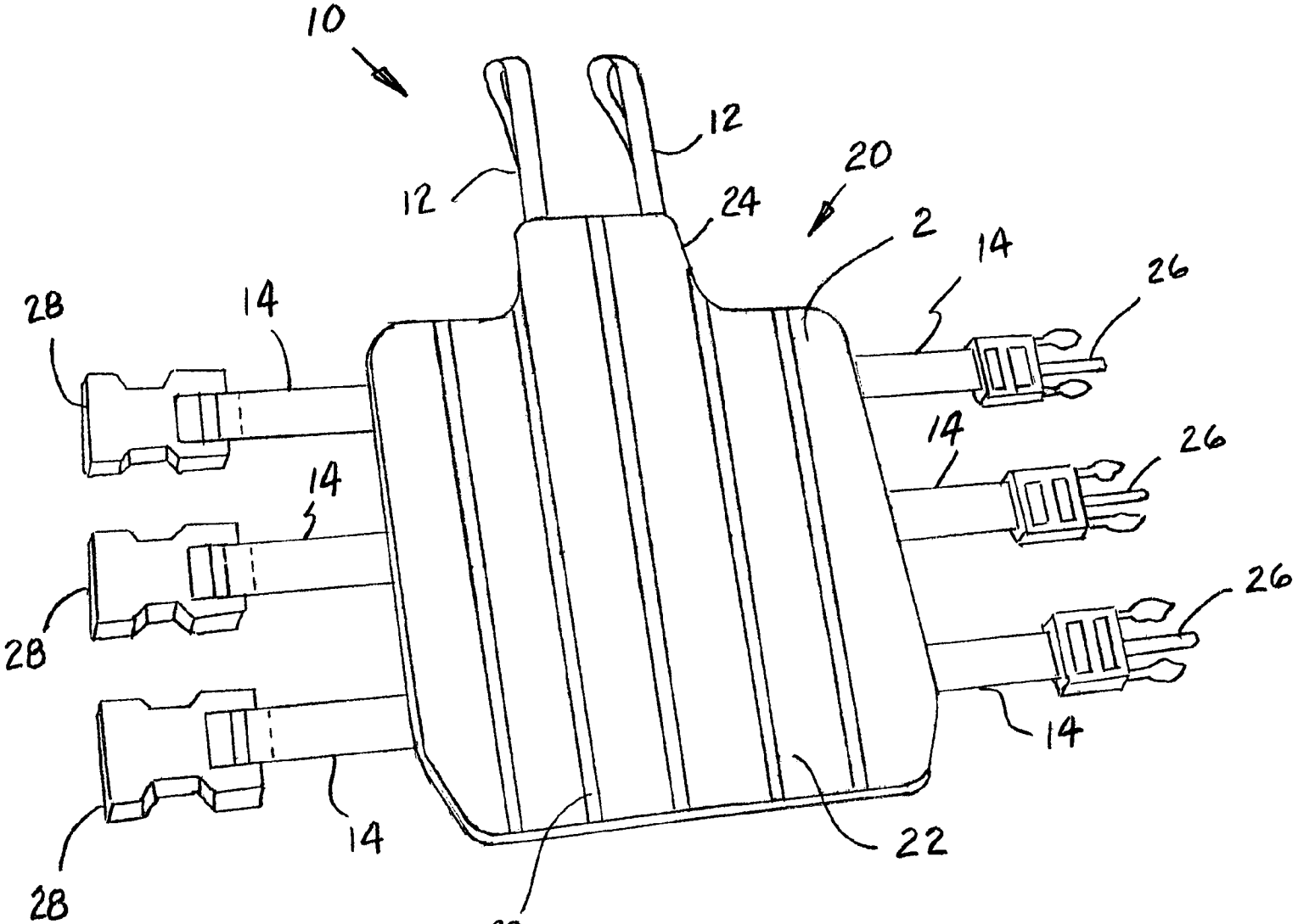
FIG. 2 is a perspective view of the apparatus shown in FIG. 1 showing the opposite side of the apparatus showing the side of the apparatus that contacts the users leg.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides an apparatus, generally designated 10, for protecting a mason or a stone worker's leg and clothing while working. The apparatus 10 comprises a leg guard, generally designated 20, having a predetermined configuration. Such leg guard 20 includes a first layer 2 having a predetermined shape and being formed from a first predetermined material, a first side of the first layer 2 for contacting a user's leg. A second layer 4 is formed from a second predetermined material and has a first side disposed adjacent and engageable with a second side of the first layer 2. A third layer 6 is formed from a third predetermined material and has a first side disposed adjacent and engageable with a second side of the second layer 4. The third layer 6 is for contacting such stone and rock being worked on. There is a plurality of first straps 12 disposed on and engageable with a top end of such leg guard 20 for securing the leg guard 20 to such user's leg. Such plurality of first straps 12 and such second straps 14 are adjustable so as fit securely against a person's leg.

Figure 3:
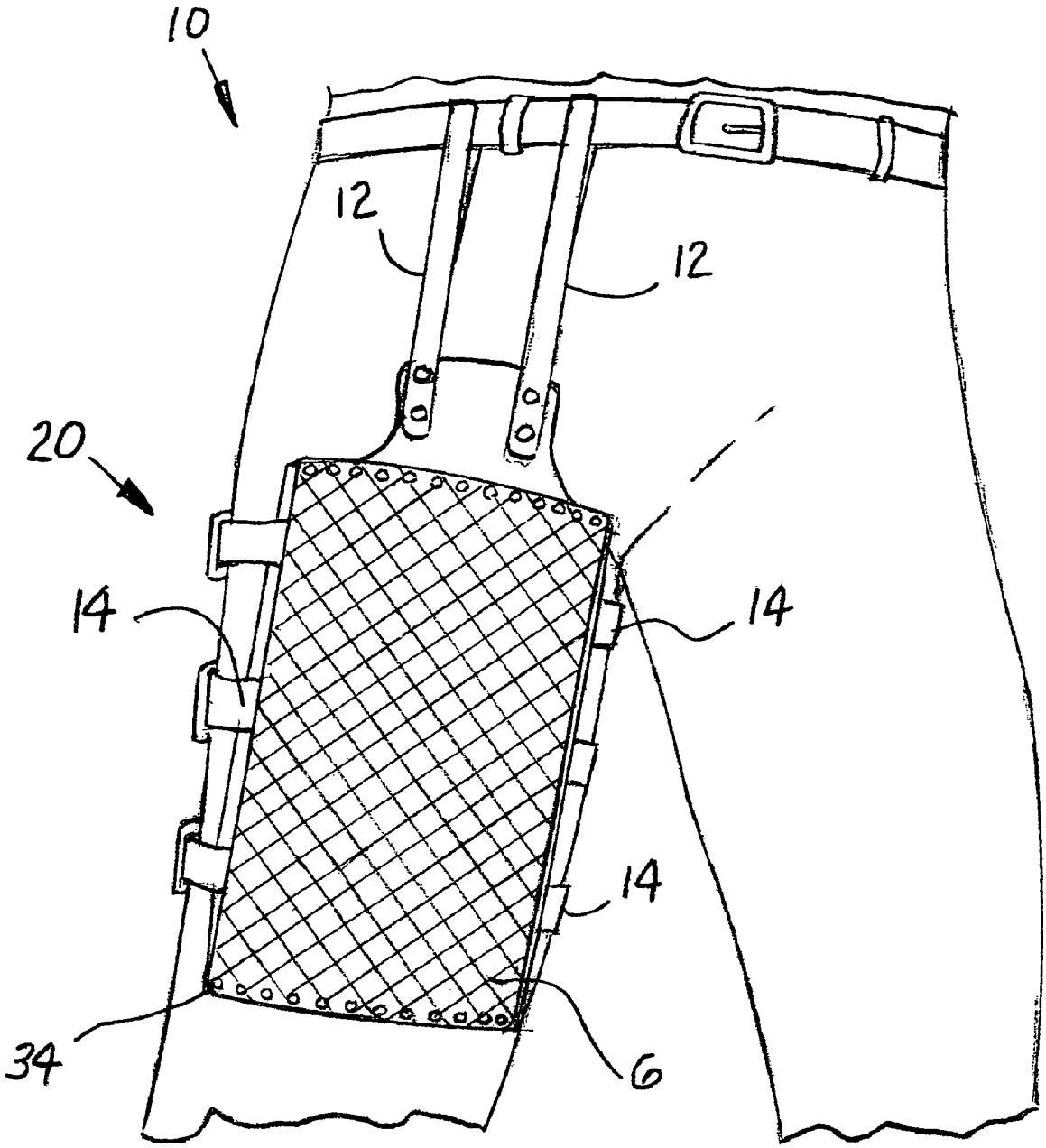
FIG. 3 is a perspective view of the apparatus showing the apparatus as it secured to a person's leg ready for use.

It should be noted that although this is referred to as a lea guard, as is clearly seen in FIG. 3, that such guard is really a thigh guard since that is the area of the lea that the stone worker uses to hold the stone or brick when it is being hammered and that is the area that requires protection both for the worker and for his clothes.

It is presently preferred that such predetermined configuration of the leg guard 20 is substantially rectangular. Such substantially rectangular configuration 22 of the leg guard 20 further includes a smaller substantially rectangular portion 24 having arcuate portions and is engageable with a top end of the substantially rectangular 22 leg guard 20, the smaller substantially rectangular portion 24 extends outwardly from the substantially rectangular configuration 22 for providing protection for an upper leg and hip area and for helping prevent debris from slipping between the leg guard and such user's clothing.

The plurality of first straps 12 are disposed on and engageable with a top end of the smaller substantially rectangular portion 24 that extends outwardly from the substantially rectangular configuration 22 of the leg guard 20. Such plurality of first straps 12 are placed over and around such user's belt and are secured using metal snaps.

The plurality of second straps 14 are connected to one side of the leg guard 20 and have male snaps 26 on each end of the plurality of the second straps 14 while the plurality of second straps 14 connected to an opposite side of the leg guard 20 have female snaps 28 on each end of the plurality of second straps 14. The plurality of second straps 14 are placed around such user's leg and each of the male snaps 26 is secured to the female snaps 28 of a matching strap 14. Such male snaps 26 and such female snaps 28 are formed of plastic.

It is also presently preferred that such first predetermined material for the first layer 2 is an elastomeric material and, further, that such elastomeric material is selected from natural rubber, synthetic rubber, plastic and combinations thereof. It is preferred that such elastomeric material is a soft synthetic rubber.

Figure 4:
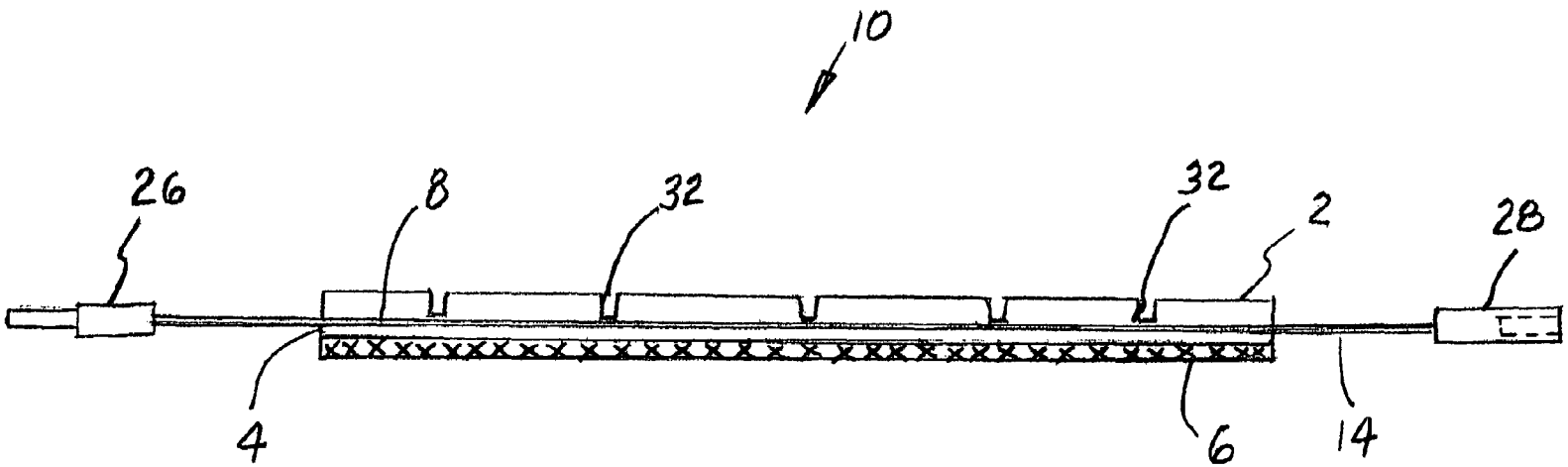
FIG. 4 is a cross sectional view of the apparatus according to an alternate embodiment of the invention.
Figure 5:
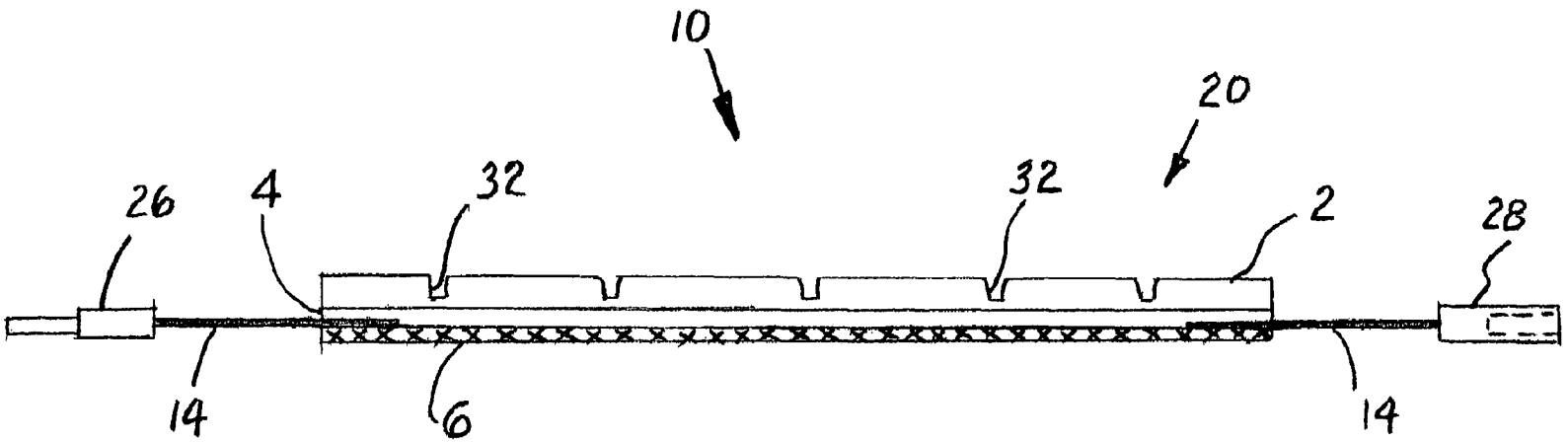
FIG. 5 is a cross sectional view of the apparatus shown in FIG. 1.

Further as seen in FIGS. 4 and 5 such elastomeric material has a plurality of grooves 32 disposed therein for providing ventilation to such user's leg. It is within the scope of the invention that such grooves can be horizontal, vertical or even crosshatched; however, it is preferred that such plurality of grooves 32 are disposed vertically on the elastomeric material of the first layer 2 of the leg guard 10.

The third predetermined material for such third layer 6 is a durable, flexible material and is selected from at least one of natural rubber, synthetic rubber, plastic and combinations thereof. Such material has to be durable because is comes in contact with stones, brick or rocks that are being hit with a hammer. Such exterior surface of such third predetermined material may have cross hatched grooves so as to engage the rock, brick or stone being worked on from slipping.

The second predetermined material of the second layer 4 is a soft rubber material. This material is used to provide a cushioning effect on the leg when such hammering takes place.

In an alternate embodiment of the invention, as seen in FIG. 4, such apparatus 10 further includes a fourth layer 6 that is disposed intermediate the first layer 2 and the second layer 4. Such fourth layer 8 is selected from one of nylon and canvas.

The different layers (first layer 2, second layer 4, third layer 6 and fourth layer 8) of such apparatus 10 are secured together by means of stitching and metal rivets 34. It is preferred that metal rivets 34 are used to secure the layers together since the apparatus takes considerable abuse from the stones, rocks or bricks being hit with a hammer and metal rivets 34 are stronger than stitching is.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

I claim:

1. An apparatus for protecting one of a mason and stone worker's thigh portion of a leg and clothing while working, said apparatus comprises:

(a) a thigh guard having a predetermined configuration, said leg guard including;

(i) at least one layer having a predetermined shape and being formed from a first predetermined material, a first side of said at least one layer contacting a user's thigh;

(ii) at least one strap disposed on and engageable with a top end of said thigh guard for securing said thigh guard to such user's belt;

(iii) a second layer formed from a second predetermined material and having a first side disposed adjacent and engageable with a second side of said at least one layer;

(iv) a third layer formed from a third predetermined material and having a first side disposed adjacent and engageable with a second side of said second layer, a second side of said third layer for contacting such stone and rock being worked on;

(v) a fourth layer disposed intermediate said at least one layer and said second layer;

(b) at least one thigh strap disposed on and connected to each side of said thigh guard for securing said thigh guard to such user's thigh; and (c) a plurality of grooves disposed on a first side of said first predetermined material for contacting such user's thigh so as to provide ventilation to such user's thigh.

2. The apparatus, according to claim 1, wherein said at least one strap disposed on and engageable with a top end of said thigh guard is a plurality of straps.

3. The apparatus, according to claim 2, wherein said at least one thigh strap is a plurality of thigh straps.

4. The apparatus, according to claim 3, wherein said predetermined configuration of said thigh guard is substantially rectangular.

5. The apparatus, according to claim 4, wherein said substantially rectangular configuration further includes a smaller substantially rectangular portion having arcuate portions and is engageable with a top end of said substantially rectangular thigh guard, said smaller substantially rectangular portion extending outwardly from said substantially rectangular configuration for providing protection for an upper leg and hip area and for helping prevent debris from slipping between said thigh guard and such user's clothing.

6. The apparatus, according to claim 5, wherein said plurality of straps are disposed on and engageable with a top end of said smaller substantially rectangular portion extending outwardly from said substantially rectangular configuration.

7. The apparatus, according to claim 3, wherein said plurality of straps are placed over and around such user's belt and are secured using metal snaps.

8. The apparatus, according to claim 3, wherein said plurality of thigh straps connected to one side of said leg guard have male snaps on each end of said thigh straps while said plurality of thigh straps connected to an opposite side of said leg guard have female snaps on each end of said thigh straps.

9. The apparatus, according to claim 8, wherein said plurality of thigh straps are placed around such user's thigh and each of said male snaps is secured to said female snaps of a matching strap.

10. The apparatus, according to claim 9, wherein said male snaps and said female snaps are formed of plastic.

11. The apparatus, according to claim 1, wherein said first predetermined material of said at least one layer is selected from natural rubber, synthetic rubber, plastic and combinations thereof.

12. The apparatus, according to claim 1, wherein said plurality of grooves are disposed vertically on said predetermined material of said thigh guard.

13. The apparatus, according to claim 1, wherein said third predetermined material is a durable, flexible material and is selected from at least one of natural rubber, synthetic rubber, plastic and combinations thereof.

14. The apparatus, according to claim 1, wherein said second predetermined material is a soft rubber material.

15. The apparatus, according to claim 1, wherein said fourth layer is selected from one of nylon and canvas.

16. The apparatus, according to claim 1, wherein said at least one layer, said second layer, said third layer and said fourth layer are secured together by means of metal rivets.

17. The apparatus, according to claim 1, wherein said at least one strap and said at least one thigh strap are adjustable.

* * * * *